United States Patent [19]

Lyons et al.

[11] 3,946,195

[45] Mar. 23, 1976

[54] DEVICE FOR BRANDING INDICIA ON A TENNIS BALL

[76] Inventors: Dianne D. Lyons, West Indies House, 26 Tide Village, Rte. 00864; William R. Chandler, 57A Salt River, both of Christiansted, St. Croix, V.I. 00820

[22] Filed: July 1, 1974

[21] Appl. No.: 484,860

[52] U.S. Cl. ..... 219/216; 101/9; 101/27; 101/31; 219/221; 219/228; 219/521

[51] Int. Cl.[2] .... H05B 1/00; H05B 3/00; B44B 5/00

[58] Field of Search ..... 219/221, 227, 228, 242, 219/521, 216; 101/4, 8–11, 21, 25, 27, 31, DIG. 17

[56] References Cited

UNITED STATES PATENTS

| | | | |
|---|---|---|---|
| 1,625,009 | 4/1927 | Whited | 219/227 |
| 1,850,280 | 3/1932 | Haynes | 219/227 |
| 1,872,730 | 8/1932 | Goldfisch | 219/521 |
| 1,905,364 | 4/1933 | Brindley | 219/227 |
| 1,981,808 | 11/1934 | Maranville | 101/9 |
| 2,002,847 | 5/1935 | Atti | 101/4 X |
| 2,047,373 | 7/1936 | Kingsley | 101/9 |
| 2,138,350 | 11/1938 | McChesney | 101/9 |
| 2,231,766 | 2/1941 | Leibowitz | 101/31 |
| 2,248,207 | 7/1941 | Tedder | 219/227 X |

FOREIGN PATENTS OR APPLICATIONS

| | | | |
|---|---|---|---|
| 100,480 | 3/1937 | Australia | 101/31 |
| 18,491 | 7/1934 | Australia | 101/31 |

*Primary Examiner*—A. Bartis
*Attorney, Agent, or Firm*—Smith, Harding, Earley & Follmer

[57] ABSTRACT

A tennis ball marker which has no moving parts in operation and in which a plurality of removable and interchangeable heating imprint modules are mounted in a housing containing an electric circuit for controlling the supply of power from a source to heat the imprint modules. The imprint modules comprise a ceramic body having an electric heating element embedded therein. The top surface of the ceramic body provides raised portions in the shape of letters or other identifying indicia which are seared onto the surface of a tennis ball placed in contact therewith. The imprint modules are readily interchangeable and are removably plugged into electrical receptacles in the housing to permit the identifying indicia to be readily changed. The housing includes window means through which the imprint modules are exposed. The window is of such size and shape as to receive and position the ball to be marked and to limit the depth that the ball can be inserted into the housing so that the indicia are seared onto the ball to a uniform desired depth.

9 Claims, 8 Drawing Figures

DEVICE FOR BRANDING INDICIA ON A TENNIS BALL

BACKGROUND OF THE INVENTION

This invention relates to tennis ball markers which apply a marking to a tennis ball for identifying its ownership.

Tennis courts are usually built in groups with several courts located side by side. During a tennis game, a ball in play will often enter an adjoining court. This may result in a disturbance while the tennis ball is recovered and identified and returned to its owner. The problem of identification is increased in the situation, which often occurs, where players have tennis balls of the same brand and color.

While a player may rely on the condition of the ball to claim ownership, this is an unreliable system and may result in controversy when two players have the same brand and color tennis ball. Accordingly, some players mark their tennis balls by the use of pen and ink in some manner to differentiate them from other similar tennis balls. This procedure is unsatisfactory because the ink markings become illegible as the ball wears with use and can smudge and stain clothing, hands, rackets and strings.

Thus, there is in the prior art no satisfactory tennis ball marker which overcomes the problem of identification of intermixed tennis balls of the same brand, color and condition.

SUMMARY OF THE INVENTION

It is the general object of the invention to provide a tennis ball marker which provides for immediate identification of the ownership of a tennis ball in all situations including where tennis balls of the same color, age, brand and condition may be intermixed. To this end, there is provided a tennis ball marker which sears or brands identifying indicia of ownership, such as the initials of the owner, onto the surface of the tennis ball to thereby clearly identify the ownership of the ball.

Briefly stated, the tennis ball marker in accordance with the invention comprises a heating means for searing a marking on the surface of a tennis ball, such heating means having an electrical resistance heating element and presenting a heating surface in the shape of an identifying indicia of ownership. The heating means is supported on a housing means so as to face outwardly for contact by a tennis ball. The housing means also contains circuit means for connecting the electrical resistance heating element to a power supply for causing the heating of the heating means whereby a tennis ball placed in contact with the surface is seared or branded with a marking in the shape of the identifying indicia.

More specifically, the heating means comprises a plurality of imprint modules removably mounted in the housing and being provided with surfaces in the shape of letters. By this arrangement, the marking means may be arranged to provide a monogram corresponding to the name of the owner of the tennis balls. Such an arrangement will serve to immediately identify the owner of the ball even in the case where two parties involved may be using tennis balls of the same color, age, brand and condition. Moreover, by reason of the searing type of marking, there is no problem with wear, ink smudging, or ink staining of clothes or the like.

The invention possesses other advantages and features which, together with the foregoing, will be pointed out specifically hereinafter. It is to be understood that the invention is not to be limited to the scope of the specific form thereof herein shown and described and that various embodiments thereof may be employed within the scope of the claims set forth hereinafter.

DESCRIPTION OF THE PREFERRED EMBODIMENT

Figure 1:
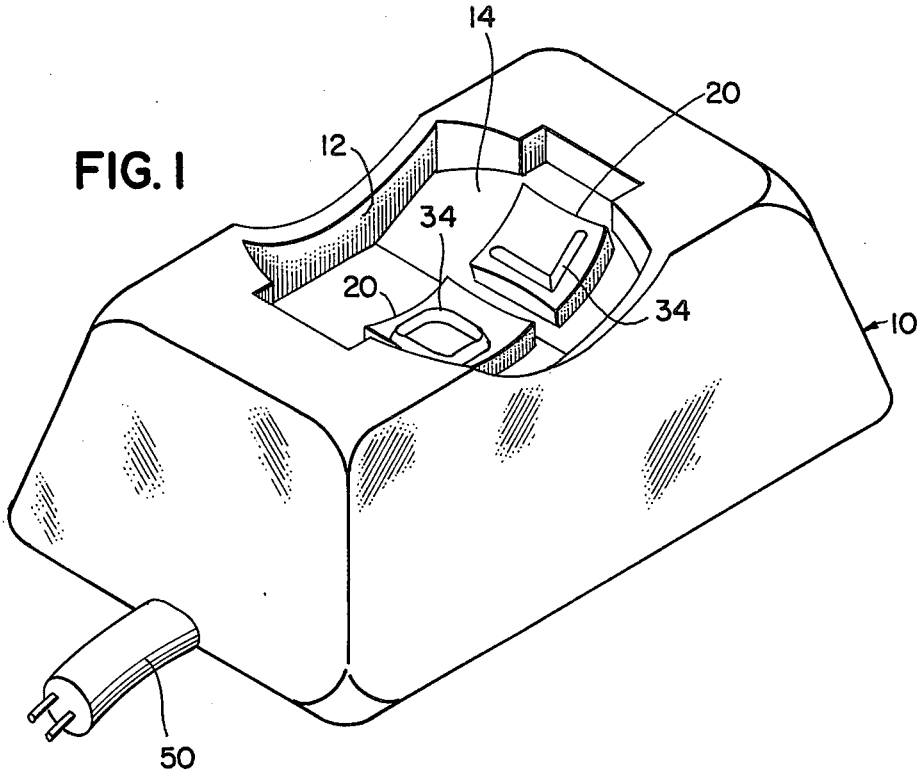
FIG. 1 is an isometric view of the tennis ball marker in accordance with the invention shown in the position in which it is normally used.

The tennis ball marker in accordance with the invention comprises a housing 10 made of a ceramic casting and providing a window opening 12 in the top wall thereof. The housing 10 has a divider wall 14 extending between the sides of the housing 10 beneath the window opening 12. The divider wall 14 has a pair of inclined portions extending inwardly and downwardly from the side walls of the housing 10 to join with an intermediate horizontal portion. A chamber 16 is formed beneath the wall 14 and is enclosed by a fiberboard bottom wall 18 extending across the bottom of the housing 10.

There are provided a plurality of imprint module assemblies 20 for use in providing a marking which will identify the tennis ball. Each module 20 comprises a ceramic body 22 which has embedded therein a pair of electrical contact prongs 24 and 26 of different sizes, prong 24 being larger than the prong 26. The prongs 24 and 26 are split axially for a portion of their length for assuring good electrical contact as will be described hereafter. The prongs 24 and 26 are interconnected by a nichrome wire 28 which is embedded in the body 22 and serves as an electrical resistance heating element. The top surface 30 of the module 20 is spherical and has a raised portion projecting upwardly therefrom. The raised portion 32 presents a surface 34 which is spherical and has a radius of curvature corresponding to that of a standard tournament tennis ball. The spherical contact surface on the indicia portion 34 of the module serves to insure uniform contact and pressure on the fabric covering of the tennis ball during a marking operation as will be described hereafter.

Figure 5:
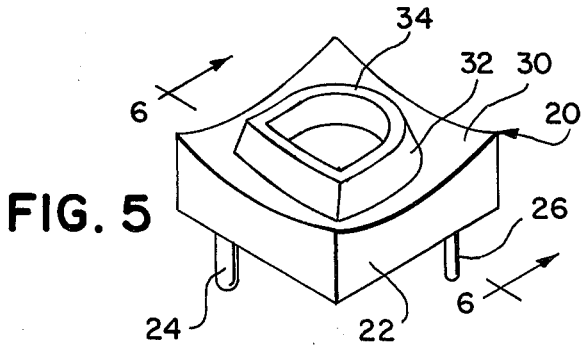
FIG. 5 is an isometric view of an imprint module used in the marker shown in FIG. 1.
Figure 6:
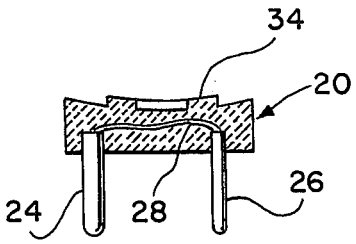
FIG. 6 is a sectional view taken on line 6—6 of FIG. 5.
Figure 7:
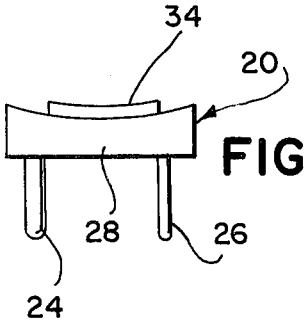
FIG. 7 is an end view of the imprint module shown in FIG. 5.

The raised portion 32 is in the shape of a letter (such as "D" in FIG. 5) or other suitable indicia for indicating identification. Preferably, there is provided an imprint module for each letter of the alphabet so as to provide a monogram marking as will be described hereafter. Of course, other identifying indicia may be utilized.

Figure 2:
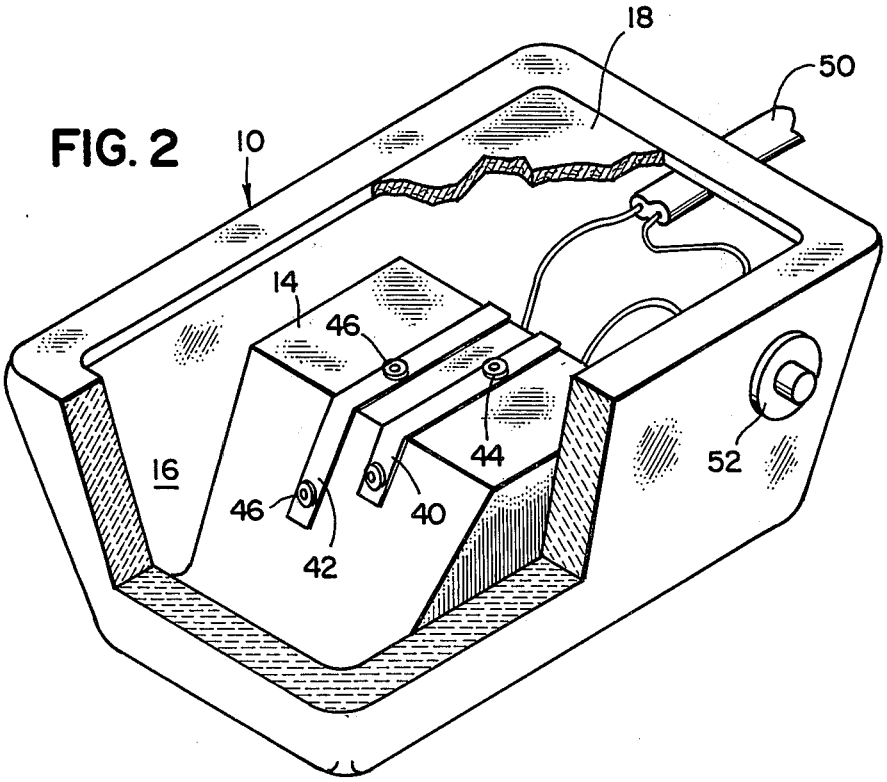
FIG. 2 is an isometric view of the marker shown in FIG. 1 with the marker being turned upside down and broken away to illustrate the interior thereof.
Figure 3:
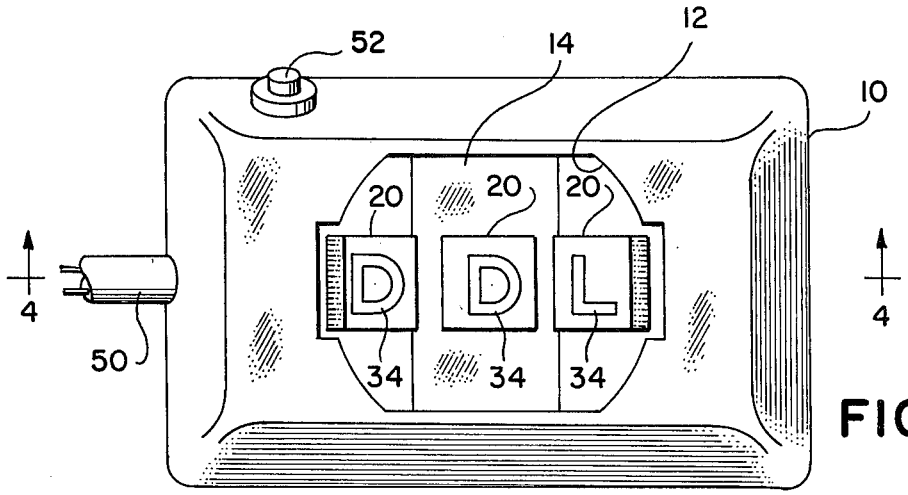
FIG. 3 is a top plan view of the marker shown in FIG. 1.
Figure 4:
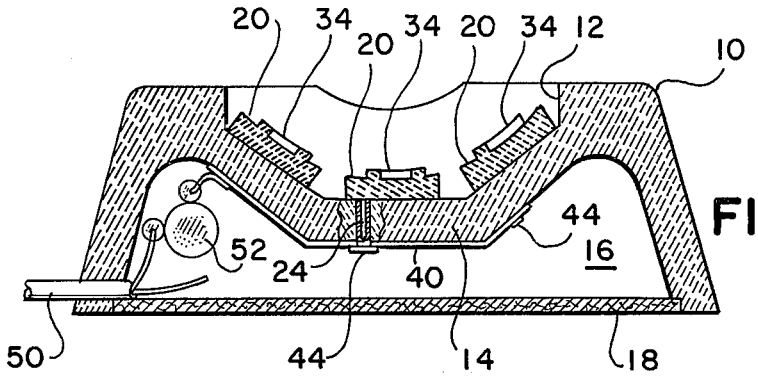
FIG. 4 is a sectional view taken on the line 4—4 of FIG. 3.

As is best shown in FIG. 2, a pair of bus bars 40 and 42 are mounted on the underside of the divider wall 14 by means of tubular rivets 44 and 46, respectively. The bus bars 40 and 42 extend along the underside of each of the three wall portions of the divider wall 14 and there is provided a rivet 44 and a rivet 46 which extend through each of these wall portions from the underside to the top thereof. The tubular rivets 44 are a size so as to receive the large prong 24 of the imprint module 20. The tubular rivets 46 are of a size to receive a small prong 26 of the imprint module 20. The internal diameter of the rivets 44 and 46 is such that the prongs 24 and 26 are received in tight frictional engagement to insure good electrical contact. The rivets 44 and 46 are spaced apart and arranged on each of the three wall portions of divider wall 14 so as to receive the prongs 24 and 26 of one of the imprint modules 20 as is best shown in FIGS. 3 and 4. Thus, each pair of associated rivets 44 and 46 on a divider wall portion serve as an electrical receptacle for the prongs 24 and 26 of an imprint module 20.

Figure 8:
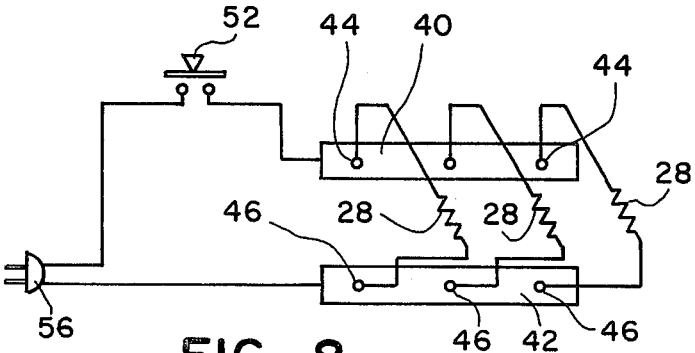
FIG. 8 is a diagram of the electrical circuitry employed in the marker in accordance with the invention.

Circuit means are provided within the housing 10 for connecting a power supply to the prongs 24 and 26 of each imprint module 20 to cause current to flow through the electrical resistance wires 28 for heating the module body 22. Such means includes the bus bars 40 and 42 and the associated rivets 44 and 46 as well as a two cord conductor 50 and a momentary push on/off switch 52. The cord 50 extends through a side wall of the housing 10 and the switch 52 is mounted in the back wall of the housing 10 as is best shown in FIG. 2. Suitable wires are provided to interconnect the switch 52 and the bus bars 40 and 42 in the manner illustrated in the circuit diagram in FIG. 8. As is shown in this figure, one line of the cord 50 extends from a conventional plug 56 to the switch 52 which is connected in series with the bus bar 40. The other line of the conductor 50 is connected between the plug 56 and the bus bar 42. The plug 56 is adapted to be received in a conventional house receptacle for connection to a power supply.

It will thus be apparent that when the plug is connected to a power supply and the switch 52 is moved to the closed position, current will be supplied to the resistance elements 28 of the modules 20 which are plugged into the socket providing rivets 44 and 46 of the bus bars 40 and 42, respectively.

In the use of the tennis ball marker in accordance with the invention, the first step is to select the appropriate identification marking that is to be placed on the tennis ball. In the illustration in the drawings, the monogram "D D L" has been selected. To this end, imprint modules 20 having these letters have been plugged into the appropriate prong receiving rivets 44 and 46 in each of the wall portions of the divider wall. The electrical resistance heating element 28 of each module 20 is thus connected between the bus bars 40 and 42 as is shown in the circuit diagram in FIG. 8.

After the plug 56 is plugged into a suitable receptacle for connecting the circuitry to a power supply, switch 52 is moved to the closed position to energize the circuitry and cause the heating up of the body 22 and the raised portion 32 of impact modules 20. When the impact modules 20 are in a heated condition sufficient to burn or scorch the cover of a tennis ball, a tennis ball is inserted through the window 12 and pressed against the surfaces 34 of the impact modules 20. The curved surface portions provide for a good support for the tennis ball and for good contact therewith to achieve a good branding-type action. Moreover, the opening 12 provides guide portions for holding the ball in a steady position during the branding operation and to restrain the inward movement of the ball so that only the raised portion 32 of the module will come into contact with the ball fabric. The tennis ball is pressed gently against the imprint modules 20 for a short time to allow the imprint to be scorched deeply into the cover thereof.

The tennis ball is thus marked clearly and decisively with identifying indicia without harming the playing value thereof.

We claim:

1. An object marker comprising a housing, removable imprint means enclosed in said housing for searing identifying indicia onto the surface of the object, heating means associated with the imprint means for heating the imprint means to searing temperature, electrical circuit means mounted in said housing and adapted to be connected to a source of electrical power, electrical connecting means extending from said heating means for removably connecting said heating means to said electrical circuit means, said electrical circuit means including electrical receptacle means mounted in said housing for removably receiving said electrical connecting means, and window means formed in said housing for exposing said imprint means and for providing access for connection of said electrical connecting means to said electrical receptacle means and said window being such size and shape as to receive and position an object which is pressed down against the imprint means to thereby mark the object with identifying indicia.

2. The marker of claim 1 wherein said object is spherical and said imprint means includes a heating surface generally spherical in shape for contacting the surface of the object.

3. The marker of claim 1 wherein said imprint, heating and connecting means comprises at least one interchangeable imprint module with a ceramic body, with the imprint means comprising a raised portion projecting upwardly from the top surface of the ceramic body, with the heating means comprising an electrical resistance heating element embedded in the ceramic body, and with the connecting means comprising a pair of electrical contact prongs connected to the electrical resistance heating element and extending downwardly from the ceramic body, said imprint module being removably mounted in said electrical receptacle means, said prongs being connected in electrical circuit with said electrical circuit means when engaged with said electrical receptacle means.

4. The marker of claim 3 wherein its provided a plurality of removable and interchangeable imprint modules.

5. The marker of claim 4 wherein said electrical circuit means includes a pair of bus bars connecting the receptacle means in parallel electrical relationship, and a switch connected in series in the electrical circuit means for turning the marker on and off.

6. The marker of claim 4 wherein said raised portions are generally spherical in shape for contacting the surface of a spherical object, the radius of curvature of said spherical shape approximating that of the spherical object, said modules being mounted in said housing relative to each other so as to be contiguous to the circumference of a tennis ball.

7. The marker of claim 6 wherein said object is a tennis ball.

8. The marker of claim 6 wherein said window means extends around the imprint modules and permits insertion of the object to contact said raised portions and limits the depth of insertion of the object so that each object is seared to a uniform desired depth.

9. An object marker for heat searing identifying indicia onto the surface of spherical objects, comprising a housing, a plurality of removable imprint modules enclosed in said housing, each having a ceramic body and provided with a raised imprint portion, an electrical resistance heating element means embedded in each ceramic body for heating said raised imprint portion to searing temperature, a pair of electrical contact prongs connected to the electrical resistance heating element means and extending downwardly from the ceramic body, an electrical circuit means mounted in said housing and adapted to be connected to a source of electrical power, said electrical circuit means including electrical receptacle means mounted in said housing for removably receiving said electrical contact prongs, window means formed in said housing for exposing the imprint portion and for providing access for connection of said electrical contact prongs to said electrical receptacle means and of such size and shape as to receive and position an object which is pressed down against the imprint modules to thereby mark the object with identifying indicia, said window means extending around the imprint modules and limiting the depth of insertion of the objects so that each object is seared to a uniform desired depth, said raised imprint portion of said imprint modules being generally spherical in shape for contacting the surface of the spherical object, the radius of curvature of said spherical shape being approximately that of a standard size tennis ball, said modules being mounted in said housing relative to each other so as to be contiguous to the circumference of the spherical object, said electrical circuit means including a pair of bus bars connecting the receptacle means in parallel relationship, and a switch connected in series in the electrical circuit means for turning the marker on and off.

* * * * *